US011287230B1

(12) United States Patent
Sclafani

(10) Patent No.: US 11,287,230 B1
(45) Date of Patent: Mar. 29, 2022

(54) LESS-THAN-LETHAL KINETIC IMPACT ROUND

(71) Applicant: RAMA Technologies, LLC, Dameron Park, CA (US)

(72) Inventor: Procopio J. Sclafani, Cameron Park, CA (US)

(73) Assignee: Rama Technologies, LLC, Cameron Park, CA (US)

( * ) Notice: Subject to any disclaimer, the term of this patent is extended or adjusted under 35 U.S.C. 154(b) by 0 days.

(21) Appl. No.: 17/393,702

(22) Filed: Aug. 4, 2021

(51) Int. Cl.
*F42B 8/02* (2006.01)
*F42B 7/08* (2006.01)
*F42B 7/02* (2006.01)

(52) U.S. Cl.
CPC ..... *F42B 8/02* (2013.01); *F42B 7/02* (2013.01); *F42B 7/08* (2013.01)

(58) Field of Classification Search
CPC ..... F42B 8/02; F42B 7/02; F42B 7/08
USPC ..... 102/439
See application file for complete search history.

(56) References Cited

U.S. PATENT DOCUMENTS 3,074,344 A * 1/1963 Henri ..... F42B 7/04 102/454
3,650,213 A * 3/1972 Abbott ..... F42B 5/02 102/436
6,012,395 A * 1/2000 Saxby ..... F42B 12/745 102/502
6,178,890 B1 1/2001 Burczynski
6,240,850 B1 * 6/2001 Holler ..... F42B 5/025 102/439
6,283,037 B1 * 9/2001 Sclafani ..... F42B 12/34 102/444
6,302,028 B1 10/2001 Guillot-Ulmann et al.
6,305,292 B1 10/2001 Burczynski et al.
6,393,992 B1 5/2002 Vasil et al.
6,530,328 B2 3/2003 Burczynski et al.
6,543,365 B1 4/2003 Vasil et al.
6,722,283 B1 4/2004 Dindl et al.
6,736,070 B2 5/2004 Baltos
(Continued)

FOREIGN PATENT DOCUMENTS

WO WO-2005098344 A1 * 10/2005 ..... F42B 8/16
WO WO-2006111719 A1 * 10/2006 ..... F42B 12/745
WO WO2009141521 A1 11/2009

*Primary Examiner* — Samir Abdosh
(74) *Attorney, Agent, or Firm* — Thomas Schneck; Mark Prosik

(57) ABSTRACT

A less-than-lethal kinetic impact projectile and an associated less-than-lethal ammunition round are provided. The projectile has a typically self-supporting, sealed cylindrical elastomeric bag with a particulate load therein and with a deformable hemispherical hollow nose cap forwardly attached to a front of the cylindrical elastomeric bag. The round has a cylindrical casing with an ignitable propellant powder charge disposed therein, and the projectile nested within the casing forwardly of the propellant powder charge. In operation, the polymer material of the cylindrical elastomeric bag with deformable hollow nose cap is such that the projectile will expand in diameter but remain intact when impacting against a soft or semi-soft target (e.g., the body of a human being or animal), but will tend to fragment, disintegrate, or open up at the back, upon impact with a hard or semi hard target (e.g., against concrete or wood).

21 Claims, 3 Drawing Sheets

(56) References Cited

U.S. PATENT DOCUMENTS

| | | | | |
|---|---|---|---|---|
| 6,807,908 | B2 | 10/2004 | Brydges-Price | |
| 7,278,357 | B2 | 10/2007 | Keith et al. | |
| 7,415,929 | B1 * | 8/2008 | Faughn | F42B 7/08 102/448 |
| 7,743,709 | B2 * | 6/2010 | Kolnik | F42B 5/02 102/521 |
| 8,205,556 | B1 | 6/2012 | Keith et al. | |
| 8,511,231 | B2 | 8/2013 | Hayes et al. | |
| 8,671,841 | B2 | 3/2014 | Raquin et al. | |
| 9,021,959 | B2 | 5/2015 | Hayes | |
| 9,140,528 | B1 * | 9/2015 | Thomas | F42B 12/36 |
| 9,182,202 | B2 * | 11/2015 | Menefee, III | F42B 7/08 |
| 9,423,222 | B1 * | 8/2016 | Thomas | F42B 12/34 |
| 9,429,405 | B1 * | 8/2016 | Balzano | F42B 12/56 |
| 10,088,287 | B2 | 10/2018 | Carlson et al. | |
| 10,527,394 | B2 * | 1/2020 | Raquin | F42B 12/78 |
| 11,009,321 | B2 * | 5/2021 | Buys | F42B 7/08 |
| 2005/0016412 | A1 * | 1/2005 | Vasel | F42B 7/10 102/502 |
| 2006/0027124 | A1 * | 2/2006 | Sclafani | F42B 12/36 102/444 |
| 2014/0109790 | A1 * | 4/2014 | Dannawi | F42B 12/34 102/502 |
| 2014/0230680 | A1 | 8/2014 | Meller | |

* cited by examiner

LESS-THAN-LETHAL KINETIC IMPACT ROUND

TECHNICAL FIELD

The present invention relates to less-than-lethal ammunition, such as rubber and plastic bullets, sponge grenades, and bean bag rounds, the projectiles of which expand or disintegrate upon impact, characterized by little or no penetration into a target and with the intended effect of pain compliance, stunning or target-marking of persons for law enforcement, riot control and the like.

BACKGROUND ART

In law enforcement, penal, self-defense, and military tactical situations, there is an increasing demand for non-lethal force options. An increasing emphasis has been placed on stopping or disabling a targeted individual without serious injury or death, and with significantly reduced risk to any non-targeted bystanders. Many options are viable for use at close range (approx. 10 m or less), including riot shields and batons, electroshock weapons, dazzlers and stun grenades, net guns, and chemical lachrymator sprays (such as capsaicin). The options for intermediate and longer ranges generally require some kind of projectile.

A variety of different less-than-lethal kinetic impact projectile weapons are now available. The term "less-than-lethal" is the preferred term rather than "non-lethal" because no projectile weapon of this kind is entirely foolproof and unintended deaths have been known to sometimes occur. For example, firing at too short a distance may deliver too much kinetic energy to the target, resulting in increased risk of penetration or blunt trauma. Likewise, missing the targeted chest area and instead hitting the face could result in concussion or blindness. The different available baton rounds have different amount of risk in this regard because of differences in firing accuracy and in the distribution or spread of the kinetic energy over the impacted area. A stable flight trajectory and the ability the projectile to expand its diameter and dissipate its energy upon impact are both required for safe operation.

In U.S. Pat. No. 6,012,395, Saxby describes a baton projectile having a low-density polyethylene (LDPE) case and a soft core of thermoplastic gel modified rubber. An air pocket between the core and the front of the case reduces the speed of sound of the impact shockwave to reduce the risk of unacceptable bone injury. At higher than acceptable impact force, the case will rupture and the core spreads out to radially disperse the excess impact energy.

In U.S. Pat. No. 6,302,028, Guillot-Ulmann et al. describe a very highly deformable projectile in which a flexible, elastic, and infrangible envelope is filled with fine grains of solid filler material which flattens and spreads upon impact with a target to minimize trauma. In another embodiment, the envelope can rupture and deliver an incapacitating chemical in powder form.

In U.S. Pat. No. 6,283,037, Sclafani describes a non-lethal shotgun round wherein the projectile is an elastomeric bag filled with a packed particulate load, optionally with a dye for marking a target. The elastomeric bag is designed to rupture upon impact dispersing the particulate matter and imparting a force sufficient to stun the target. In U.S. Patent Application Publication 2006/0027124, Sclafani introduces a cylindrical foam liner surrounding the projectile to contain the round during flight for better trajectory guidance and which, upon impact, deforms the elastomeric bag to a wider surface area before rupture for a reduced risk of injury.

In U.S. Pat. No. 8,671,841, Raquin et al. describe a kinetic projectile with controlled, non-lethal effects having an external casing made of low hardness material (30 to 50 Shore hardness is recommended) that is a highly deformable elastic or viscoelastic polymer with an elongation at break in excess of 100%, and an internal structure made of low-density cellular material (such as a foam polymer) with an elongation at break of less than 10%. A cavity within the internal structure could contain a material of different elastic deformation properties to produce "complementary effects" (spring compression, buckling, creeping, etc.), while another cavity could embed a payload (such as a pyrotechnic composition to make a deafening sound with a blinding light).

In U.S. Patent Application Publication 2014/0109790, Dannawi et al. describe a less lethal projectile having an overall cylindrical shape with an approximately spherical front-end cap or outer case made of a thermoplastic (e.g., EPDM) foam about 1 to 3 mm thick, a core made of a stabilized aluminum foam with a low density of about 300 $kg/m^3$ to limit the impact force, a rear base, and a cylindrical blind recess at the back end of the core just in front of the rear base that could be filled or left empty to tailor beforehand the impact force profile and projectile effectiveness according to the severity sought.

SUMMARY DISCLOSURE

A less-than-lethal kinetic impact projectile and an associated less-than-lethal ammunition round are provided. The projectile has a sealed cylindrical elastomeric bag with a particulate load therein and with a deformable hollow nose cap forwardly attached to a front of the cylindrical elastomeric bag. The round has a cylindrical casing with an ignitable propellant powder charge disposed therein, and the projectile nested within the casing forwardly of the propellant powder charge. In operation, the elastomeric bag with deformable hollow nose cap will expand in diameter but remain intact when impacting against a soft or semi-soft target (e.g., the body of a human being or animal), but will tend to fragment or disintegrate upon impact with a hard or semi-hard target (e.g., against concrete or wood).

In one embodiment, the deformable hollow nose cap could have a substantially hemispherical shape with a hollow interior. It may be composed of a polymer with a Shore type-A durometer hardness of 50±10 and an ultimate elongation of at least 250%, such as an ethylene propylene diene monomer (EPDM) or silicone elastomer. The elastomeric bag itself could either have a self-supporting cylindrical shape or, if a flexible polymer membrane, be surrounded by a rigid but fragmentable-upon-impact outer cylindrical collar lining.

DETAILED DESCRIPTION

Figure 1:
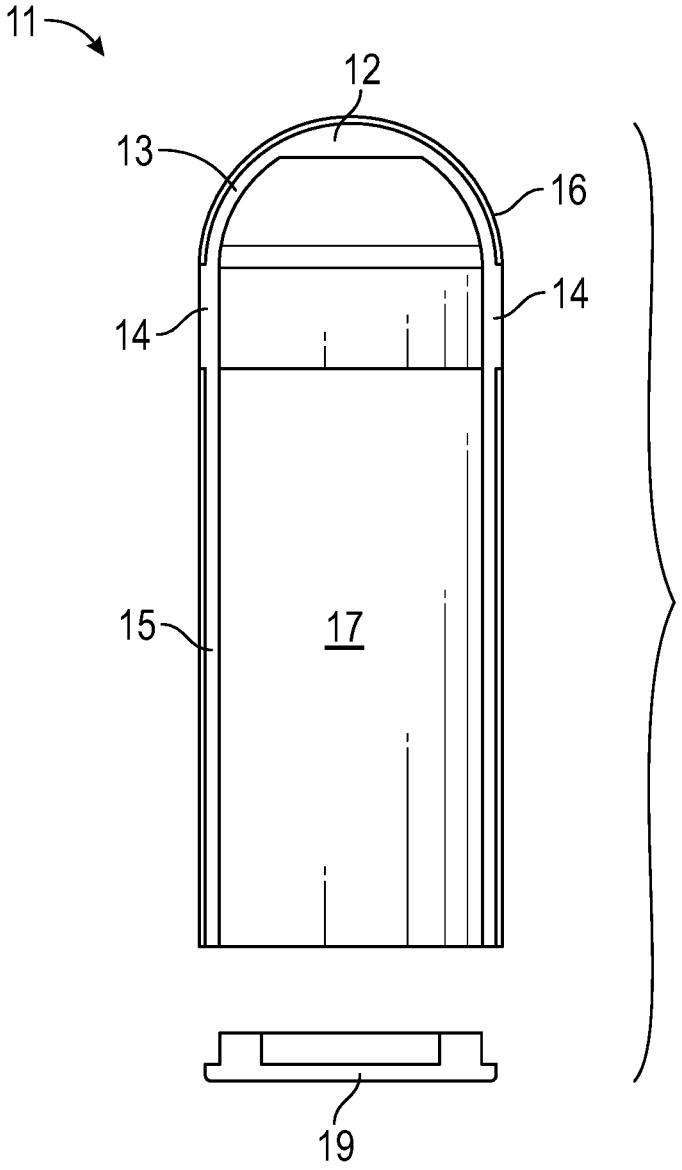
FIG. 1 is a side sectional plan view of a projectile in accord with the present invention.

With reference to FIG. 1, a less-than-lethal kinetic impact projectile 11 is seen to have a generally cylindrical shape with a soft hollow hemispherical nose cap 13 on its front end. More specifically, the projectile 11 may be comprised of a sealed cylindrical elastomeric bag 15 with a particulate load 17 therein and with a deformable hollow nose cap 13 forwardly attached to a front 14 of the cylindrical elastomeric bag 15. Dimensions (in inches) shown are merely representative of one possible projectile size.

Both the bag 15 and attached nose cap 13 are composed of an elastomeric material which is a polymer with a Shore type-A durometer hardness of 50±10 and an ultimate elongation of at least 250%. For example, they may be composed of a material selected from any of an ethylene propylene diene monomer (EPDM) elastomer and a silicone elastomer. The elastomer material used may be of any color, which may be desirable to help visibly distinguish the rounds from otherwise similar lethal rounds. Different textures on the outside of the cylindrical portion 15 of the projectile 11 are also possible to give the rounds a distinctive feel. The bag 15 and nose cap 13 could be composed of identical material; although this is not strictly necessary, so the nose cap 13 could be made up of a different elastomer from the bag 15. The deformable hollow nose cap 13 could have a 2 mm (0.08 inch) thickness at its forward impact zone 12 and a 1 mm (0.04 inch) thickness where it attaches to the front end 14 of the cylindrical elastomeric bag 15. The front end 14 of the cylindrical bag 15 could be reinforced against breakage with a band of thicker elastomer than the rest of the cylindrical bag 15.

The elastomeric bag 15 preferably has a self-supporting cylindrical shape to generally maintain its shape in flight for maximum trajectory stability. However, if the bag 15 is made of a more flexible polymer membrane material that is not self-supporting, it can be surrounded by a relatively more rigid but fragmentable-upon-impact outer cylindrical collar lining 16, such as a foam polymer, to allow the projectile to generally hold its shape in flight. Such a collar 16 around the outside of the projectile also increases the rigidity and helps ensure that projectile dissipates energy on impact without increasing the possibility of penetrating the target. If desired, it could be used even where the bag material has a self-supporting cylindrical shape.

The projectile 11 has a diameter that is selected to fit within a desired ammunition casing. A wide variety of platforms can be supported in a range from 7.62 mm (0.30 inch) to 20 mm (0.787 inch) diameters. For example, if the projectile is desired to be used with a 12-gauge shotgun, it may have a 18 mm (0.71 inch) outer diameter to fit snuggly within the plastic hull of a 12-gauge shotgun-type casing.

The cylindrical elastomeric bag portion 15 of the projectile 11 is partially filled with an inert load material 17. The ammunition could be assembled with any type of inert material upon request. It could also include a colored dye, if requested. The interior of the cylindrical elastomeric bag 15 could have any of a variety of textures from smooth to rugged to affect the behavior of the load material during flight and upon impact with the introduction of a specified amount of internal wall friction. The back end 18 of the cylinder bag 15 is then sealed with a base 19 to keep all the material inside the bag 15 and give it stability in the round casing. This base 19 could also be formed of a more rigid polymer material than the bag 15 with a generally planar circular disc shape and with an annular projecting lip or rim 20 that fits snuggly within the back 18 of the cylindrical bag 15. The projectile 11 may have a total mass in a range 17.17±0.97 grams (265±15 grains).

In manufacture, the back seal 19 would typically be attached to back 18 of the projectile's elastomeric bag 15 after it has been filled and sealed with the particulate load material 17. The base 19 fitting into the cylinder 15 has an internal rim 20 to properly secure the particulate material 17 within, being secured with an adhesive to the back end of the bag. The assembled projectile 11 is now ready to be inserted into a prepared round casing.

Figure 2:
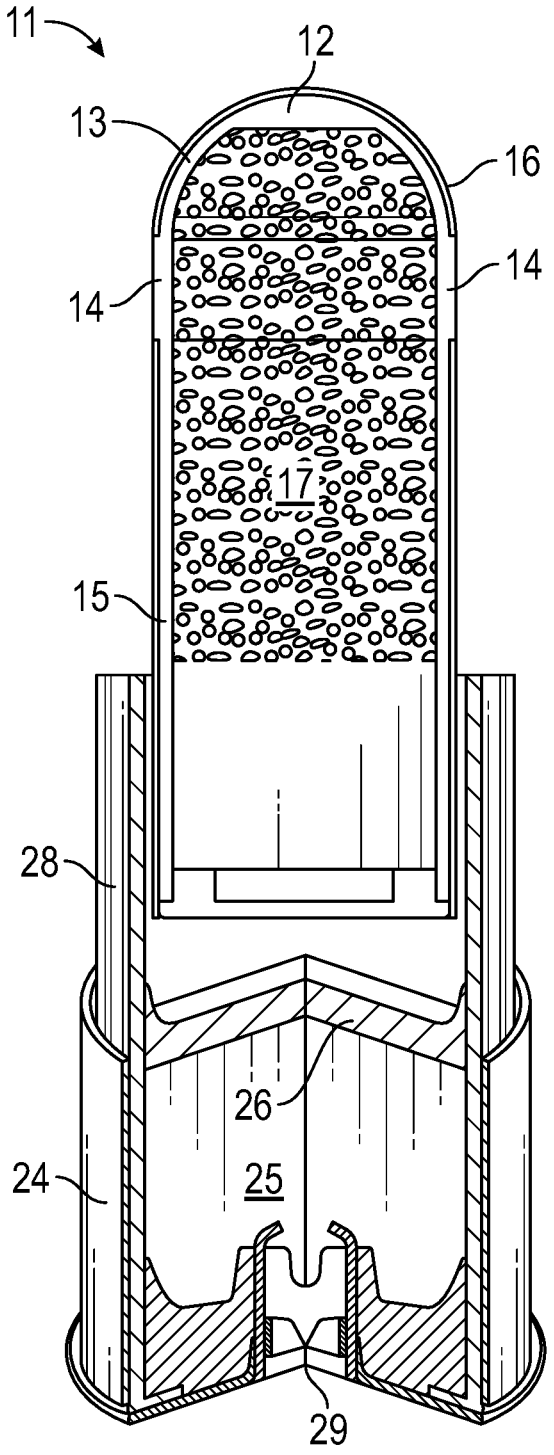
FIG. 2 is a side sectional plan view of a round with the projectile of FIG. 1 inserted onto a casing.

With reference to FIG. 2, an assembled less-than-lethal kinetic impact round 21 comprises the afore-described projectile 11 nested within a cylindrical casing 23. The casing 23 has an ignitable propellant powder charge 25 disposed therein and the projectile 11 is nested within the casing 23 forwardly of that propellant powder charge 25. In one possible embodiment, the casing 23 may comprise a metal base 24 and a plastic hull 28 annularly inserted into the base 24. The propellant powder charge 25 is rearwardly disposed in the base 24 with a wad 26 forwardly disposed as a barrier over the powder charge 25. A percussion-actuated primer fuse 29 is provided on the rearward outside of the base 24 for igniting the propellant powder charge 25 when struck by the gun hammer. The casing 23 may contain a specified amount of ignitable propellant powder 25 charge to generate, when ignited, an exit muzzle velocity for the projectile 11 in a range of subsonic velocities from 75 $ms^{-1}$ to 320 $ms^{-1}$ (250 to 1050 fps), and more preferably a range of 150±50 $ms^{-1}$ (500±150 fps), such as a 165 $ms^{-1}$ (550 fps) exit velocity for the projectile. The various platforms and their associated round gauges and calibers (such as 10-gauge, 12-gauge, 20-gauge, 28-gauge, 20 mm, 40, 38/37, .45 ACP, 9 mm, .308 calibers) can be manufactured upon request. Depending on the projectile dimensions and muzzle velocity, it will typically have a maximum absolute range upwards of 45 m to 180 m (150 to 600 ft) but with a somewhat shorter maximum target accurate range of approximately 25 m to 50 m (75 to 165 ft). The accuracy range is influenced not only by the projectile mass, shape, weight, and power charge, but also the gun barrel's length, the user's skill level and the tactical situation. The round will also have an impact effective range-to-target, in which sufficient kinetic energy is delivered to the target to achieve the desired compliance, of approximately 5 m to 30 m (15 to 90 ft), but which could reach as far as the maximum target accurate range. At the shortest distances to target, there will also be an unsafe or too-close range of around 2 m to 5 m (6 to 15 ft) where the risk of projectile penetration and traumatic injury is too high. The approximate ranges given here are round-specific but indicate that the rounds are generally most useful at intermediate engagement distances and that the rounds could be tailored for shorter or longer distances, e.g., by changing the amount of filled load material and projectile charge (mass and velocity).

Figure 3A:
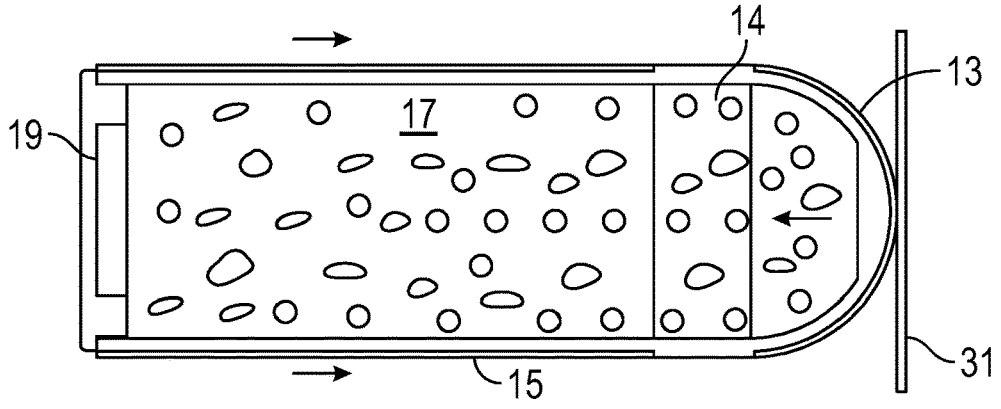
FIGS. 3A-3C are a sequence of side sectional plan views of a projectile as it hits a target.
Figure 3B:
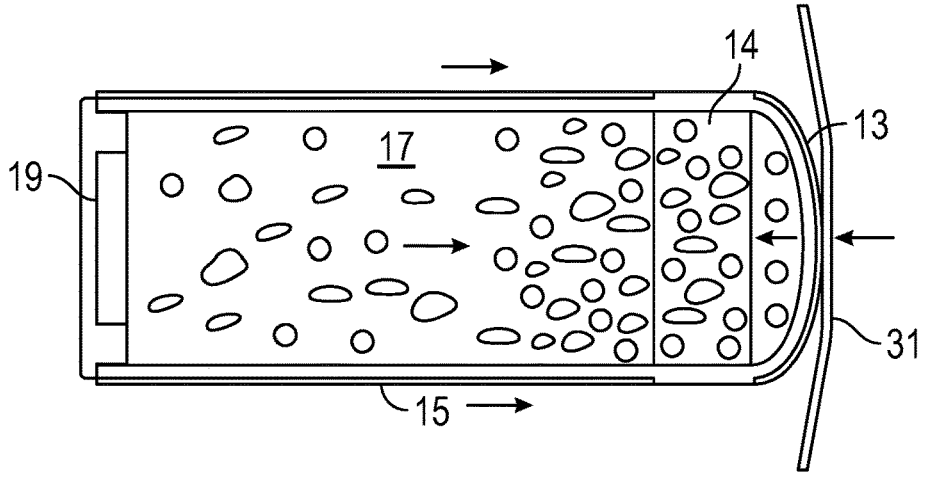
Figure 3C:
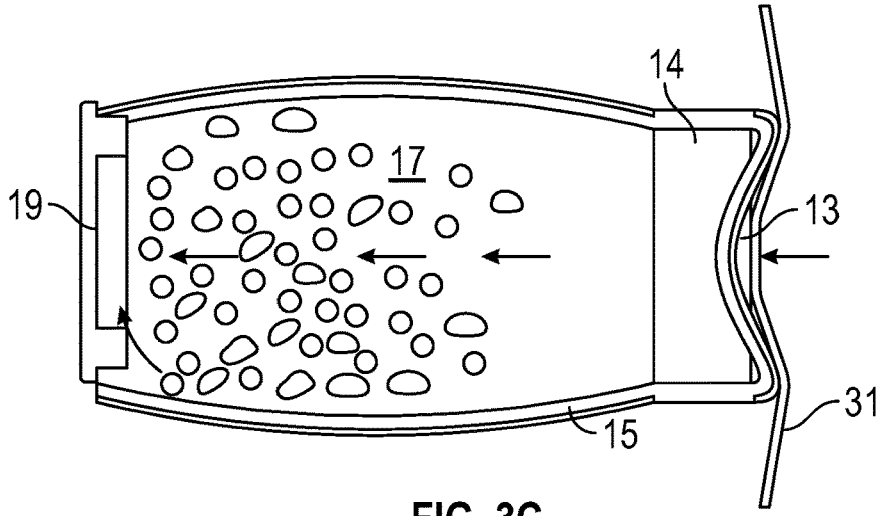

With reference to FIGS. 3A-3C, once the shell's primer has been ignited, the projectile 11 is pushed forward into the barrel by the ignited propellant charge inside the hull. The projectile 11 accelerates through the length of gun barrel and exits at a specified muzzle velocity. After this, air resistance takes over and the projectile gradually slows on its trajectory to the target.

The round's trajectory stability provides a typical capability of impacting within a circle of about 23 cm (9 inches) diameter at a standard recommended safe range (e.g., at 25 m or 80 ft) in a testing scenario. The accuracy of the shot naturally increases the closer the target becomes, and the opposite occurs when the intended target is further away. Real life field applications and hyper-dynamic "combat mode" situations are quite different, with our human limitations and circumstances of the unfolding events making it a more difficult task to place multiple shots near the same spot on the target(s), especially if target acquisition and accuracy is compromised.

While it is in flight towards the target, the air resistance affects the soft nose tip 13, as well as the outside wall around the cylindrical elastomeric sack 15. Specifically, the air resistance will cause a small deformation on the soft tip nose 13 by pushing back the inert particular load material 17 and air inside the cylinder 15. This causes a rear push of the load material 17 (a turbulent "mini-storm" with mixture of hot air and inert material) and starts the weakening process of the rear sealed cup 19 on the rim area.

Upon impacting any target 31 from very hard to very soft, the projectile 11 will experience some type of deformation such as flattening or changing into various shapes to accommodate the hollow nose cap 13 and the loaded cylinder 15 behind it. Impact energies at 30 m (100 ft) will typically range from 100 J to 300 J (75 to 220 ft-lb). Once the projectile 11 has impacted the target 31, it is going to experience a cross-section increase at the front band area 14 where the hollow nose cap 13 is attached to the cylindrical sack 15. Due to its forward momentum, the inert load material 17 and air that are loosely distributed inside the cylindrical elastomeric sack 15 during flight will move suddenly forward at the instant that the target 31 is impacted and then as a reaction of the target resistance and the depression of the front nose end 13 of the projectile 11 suddenly will ricochet or push back towards the cylinder's rear end cap 19, seeking a way out.

The above action (deformation of the hollow nose cap 13 and the forward-backward movement of the load material 17) causes a kinetic energy release upon impacting any type of target, and an internal energy collapse, bursting, or fragmenting of the elastomeric sack 15 upon impact with hard or semi-hard targets, and therefore avoids penetration and minimizes risk of any damage. The hardness of the target 31 will determine the rapidity of the projectile's deceleration and the deformation of the projectile. The cylindrical side walls 15 of the projectile 11 may bow outward (as seen in FIG. 3C), but the more rapid deceleration upon impact with a harder, less yielding target, will tend to expand sufficiently that the projectile's rear cap 19 dislodges, emptying the projectile 11 of its particulate load 19 as it rushes backward toward the cap 19. A softer, more yielding target 31 will produces a slower deceleration and backward ricochet of the particulate load 15, so that the end cap 19 remains in place.

The accumulated kinetic energy stored in the projectile 11 is released and allowed to pass through into the target and achieve the desired results, such as pain compliance either upon a human or animal target. If the projectile impacts a hard target (e.g., concrete), it should burst, fragment, or disintegrate by hard resistance of the target to release 99% of its kinetic energy into the target, with no penetration. Likewise, if it directly impacts a medium-hard target (e.g., wood), it is likely (and preferably should) burst, fragment, or disintegrate by medium resistance of the target to release 66% of its kinetic energy into the target (the remainder be dissipated as the load material sprays out the back of the now ruptured projectile, again with no penetration. If the projectile instead impacts a soft or medium-soft target (e.g., the body of a human or animal), it will normally remain intact without bursting or disintegrating (except for any rigid collar), releasing about 33% of its kinetic energy into the target without penetration. This assumes the target is not too close, so impact occurs within the projectile's mandated safe operating range.

What is claimed is:

1. A less-than-lethal kinetic impact projectile for insertion onto a propulsive casing, comprising:

a cylindrical elastomeric bag portion with a self-supporting cylindrical shape, partially filled with particulate load material therein and sealed at a back end thereof; and a deformable hollow nose cap forwardly attached to a front end of the cylindrical elastomeric bag portion, with a thicker forward impact zone relative to its thickness where it attaches to the cylindrical elastomeric bag portion.

2. The projectile as in claim 1, wherein the deformable hollow nose cap has a substantially hemispherical shape with a hollow interior.

3. The projectile as in claim 1, wherein the deformable hollow nose cap is composed of a polymer with a Shore type-A durometer hardness of 50±10 and an ultimate elongation of at least 250%.

4. The projectile as in claim 3, wherein the deformable hollow nose cap is composed of a material selected from any of an ethylene propylene diene monomer elastomer and a silicone elastomer.

5. The projectile as in claim 1, wherein the cylindrical elastomeric bag portion has an 18 mm (0.71 inch) outer diameter to fit snuggly within a 12-gauge shotgun-type casing.

6. The projectile as in claim 1, wherein the deformable hollow nose cap has a 2 mm (0.08 inch) thickness at its forward impact zone and a 1 mm (0.04 inch) thickness where it attaches to the cylindrical elastomeric bag portion.

7. A less-than-lethal kinetic impact round, comprising:

a cylindrical casing having an ignitable propellant powder charge disposed therein; and a projectile nested within the casing forwardly of the propellant powder charge, the projectile having a cylindrical elastomeric bag portion with a self-supporting cylindrical shape, partially filled with particulate load material therein and sealed at a back end thereof and with a deformable hollow nose cap forwardly attached to a front end of the cylindrical elastomeric bag portion, with a thicker forward impact zone relative to its thickness where it attaches to the cylindrical elastomeric bag portion.

8. The round as in claim 7, wherein the casing comprises a metal base and a plastic hull annularly inserted into the base, the propellant powder charge rearwardly disposed in the base with a wad forwardly disposed as a barrier over the powder charge, and a percussion-actuated primer fuse on the rearward outside of the base for igniting the propellant powder charge.

9. The round as in claim 7, wherein the deformable hollow nose cap has a substantially hemispherical shape with a hollow interior.

10. The round as in claim 7, wherein the deformable hollow nose cap has a 2 mm (0.08 inch) thickness at its forward impact zone and a 1 mm (0.04 inch) thickness where it attaches to the cylindrical elastomeric bag portion.

11. The round as in claim 7, wherein the deformable hollow nose cap is composed of a polymer with a Shore type-A durometer hardness of 50±10 and an ultimate elongation of at least 250%.

12. The round as in claim 11, wherein the deformable hollow nose cap is composed of a material selected from any of an ethylene propylene diene monomer elastomer and a silicone elastomer.

13. The round as in claim 7, wherein the projectile has a mass in a range 17.17±0.97 grams (265±15 grains).

14. The round as in claim 7, wherein the casing has a diameter in range from 7.62 mm (0.30 inch) to 20 mm (0.787 inch).

15. The round as in claim 7, wherein the cylindrical elastomeric bag portion has an 18 mm (0.71 inch) outer diameter and fits snuggly within a 12-gauge shotgun-type casing.

16. A less-than-lethal kinetic impact round, comprising:

a cylindrical casing having a metal base and a plastic hull annularly inserted into the base, an ignitable propellant powder charge rearwardly disposed in the base with a wad forwardly disposed as a barrier over the powder charge, and a percussion-actuated primer fuse on the rearward outside of the base for igniting the propellant powder charge; and a projectile nested within the plastic hull forwardly of the wad, the projectile having a cylindrical elastomeric bag portion of uniform material with a self-supporting cylindrical shape, partially filled with particulate load material therein and sealed at a back end thereof and a deformable nose cap forwardly attached to a front end of the cylindrical elastomeric bag portion, with a thicker forward impact zone relative to its thickness where it attaches to the cylindrical elastomeric bag portion.

17. The round as in claim 16, wherein the deformable nose cap is composed of a polymer with a Shore type-A durometer hardness of 50±10 and an ultimate elongation of at least 250%.

18. The round as in claim 17, wherein the deformable hollow nose cap is composed of a material selected from any of an ethylene propylene diene monomer elastomer and a silicone elastomer.

19. The round as in claim 16, wherein the deformable nose cap has a substantially hemispherical shape with a hollow interior.

20. The round as in claim 16, wherein the deformable nose cap has a 2 mm (0.08 inch) thickness at its forward impact zone and a 1 mm (0.04 inch) thickness where it attaches to the cylindrical elastomeric bag portion.

21. The round as in claim 16, wherein the cylindrical elastomeric bag portion has an 18 mm (0.71 inch) outer diameter and fits snuggly within the plastic hull of a 12-gauge shotgun-type casing.

* * * * *